US006695221B2

(12) United States Patent
Lussier

(10) Patent No.: US 6,695,221 B2
(45) Date of Patent: Feb. 24, 2004

(54) INDOOR WATERFALL SYSTEM

(76) Inventor: Robert Donald Lussier, 36 Carter Ave., Blackstone, MA (US) 01504

( * ) Notice: Subject to any disclaimer, the term of this patent is extended or adjusted under 35 U.S.C. 154(b) by 173 days.

(21) Appl. No.: 10/061,992

(22) Filed: Jan. 31, 2002

(65) Prior Publication Data

US 2002/0162897 A1 Nov. 7, 2002

Related U.S. Application Data

(60) Provisional application No. 60/265,282, filed on Feb. 1, 2001.

(51) Int. Cl.[7] ..... E03B 9/20; B05B 17/08

(52) U.S. Cl. ..... 239/17; 239/16; 239/20; 239/23

(58) Field of Search ..... 239/17, 16, 12, 239/20, 23, 127, 67, 68, 69, 70

(56) References Cited

U.S. PATENT DOCUMENTS 4,598,503 A * 7/1986 Berger et al. ..... 52/27
5,167,368 A * 12/1992 Nash ..... 239/17
5,584,991 A * 12/1996 Wittstock et al. ..... 210/151
5,799,609 A * 9/1998 Burns et al. ..... 119/74
6,527,257 B1 * 3/2003 Schuld ..... 261/29

* cited by examiner

*Primary Examiner*—David Hwu

(57) ABSTRACT

A system for waterfall construction and assembly designed for and intended for use by a user comprising of a kit of pre-designed, engineered and manufactured parts wherein each constituent part, when assembled by a user, constitutes a complete waterfall assembly. Primary components of the waterfall system include a remote reservoir, remote pump located in or adjacent to a remote located reservoir, an interim basin, an upper distribution basin, and a user furnished and selected waterfall facing material.

Water is circulated distributed and regulated within the upper distribution basin and interrupted in the interim basin to enhance sound prior to it returning to a remote located reservoir to be re-circulated.

4 Claims, 7 Drawing Sheets

SECTION 1

SECTION 1

SECTION 1

SECTION 1

SECTION 1

SECTION 1

SECTION 2

SECTION 2

SECTION 2

INDOOR WATERFALL SYSTEM

This applcation claims the benefit of Provisional Application No. 60/265,282, filed Feb. 1, 2001.

BACKGROUND OF THE INVENTION

This invention pertains to indoor waterfalls and specifically to a system by which, pre-designed, engineered and manufactured waterfall components are assembled together by a user to form a complete waterfall assembly.

DESCRIPTION OF PRIOR ART

The prior art represented are as follows by list of patents.

1. Nash U.S. Pat. No. 5,167,368
2. Dunn U.S. Pat. No. 4,747,538
3. Erickson U.S. Pat. No. 3,921,902
4. Gosh U.S. Pat. No. 3,409,223
5. Chatten U.S. Pat. No. 3,212,713
6. Zysk U.S. Pat. No. 3,211,378

SUMMARY OF THE INVENTION

Rendered Wall, Indoor Waterfall System is a system of pre-designed, engineered and manufactured waterfall components that when combined with a waterfall facing material such as stone, glass, metal, acrylic or another similar material, constitute a complete indoor waterfall assembly. The system is designed and intended to provide a user the components to independently construct an indoor waterfall of practically any user-defined height and width from a pre-designed, engineered and manufactured kit of parts.

It is an object of this invention to provide a system of pre-designed engineered and manufactured waterfall components to a user for the assembly of a waterfall in any structure, building or exterior space affording means of structural support.

In addition it is an object of this invention to incorporate, as a waterfall system component, a remote reservoir from which re-circulated water may be stored, replenished automatically, tested and treated as required.

In addition it is an object of this invention to provide a remote reservoir waterfall pump within or adjacent to the remote reservoir to acoustically isolate all unwanted mechanical sounds from the remote located waterfall assembly.

In addition it is an object of this invention to provide a system of pre-designed, engineered and manufactured waterfall components that are so designed to be arranged and assembled as desired by the user to attain any required height or width.

In addition it is an object of this invention to incorporate, as a waterfall system component, an interim basin where water re-circulates through the interim basin assembly to simulate the sound of a natural stream. The natural stream sound is simulated by deflecting and interrupting the falling water by means of a perforated cant strip within the interim basin prior to returning to a remote reservoir or re-circulation.

In addition it is an object of this invention to allow a user the option to incorporate into the waterfall system the users' own choice of waterfall facing material i.e.: stone, glass, metals, acrylic and similar materials that the user may supply or have installed independently.

In addition it is an object of this invention to incorporate, as a waterfall system component, a waterfall facing material that will install vertical, parallel to the installed wall surface and supported from two edges (top and bottom).

In addition it is a object of this invention to produce an indoor waterfall that does not rely on vertical edges or vertical end caps to the waterfall facing material to guide the circulating water. The waterfall facing material is intended as a user defined component that may have unencumbered and exposed vertical edges.

In addition it is an object of this invention to provide a system of pre-designed, engineered and manufactured waterfall components that are arranged and assembled as desired by a user to attain any desired height or width.

Lastly, it is an object of this invention to provide a waterfall system by which a user is allowed the option to independently install all waterfall system components in any building type, construction type and in several built-in configurations within or outside of any structure.

DESCRIPTION OF THE PREFERRED EMBODIMENT

Figure 1:
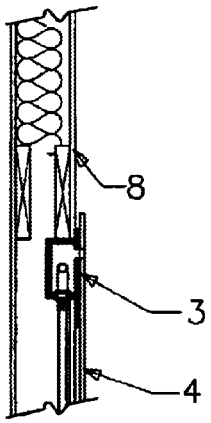
FIG. 1 and FIG. 1A illustrate a cross-section of the invention and the constituent components in the context of an example building structure. The section illustrates an example of one possible installation.
Figure 2:
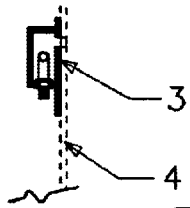
FIG. 2 and FIG. 2A are vertical cross-sections of the invention showing the four primary system components: remote reservoir, interim basin, upper distribution basin, and waterfall facing material.
Figure 1A:
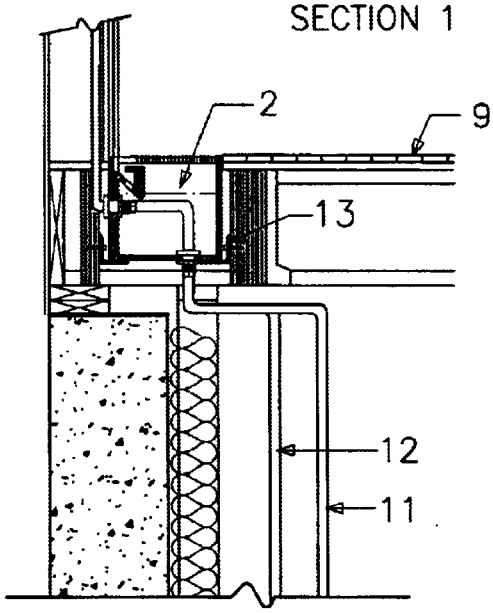
Figure 1A:
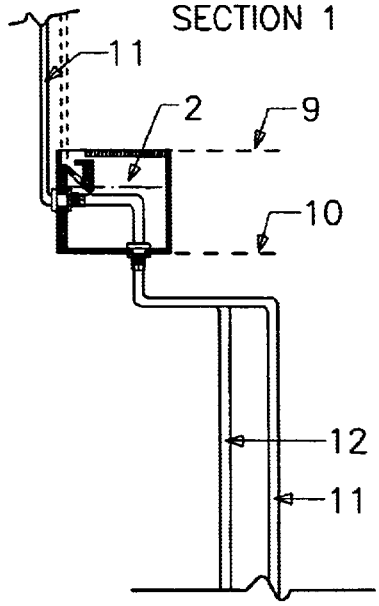
Figure 1A:
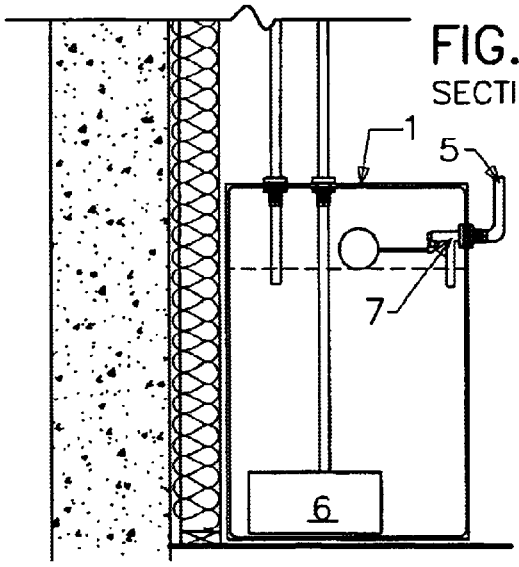
Figure 2A:
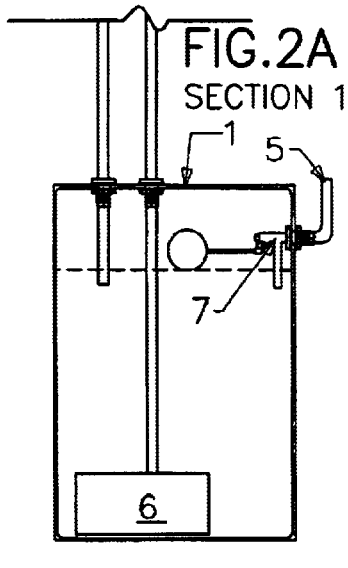

Referring to a detailed description of the invention beginning with FIG. 2: FIG. 2 and FIG. 2A show four distinct components of the indoor waterfall system, 1,2,3,4. Reference character 1 is the remote acoustically isolated reservoir including pump,6, water supply,5, automatic fill/shutoff,7, waterfall supply pipe,11, and return/overflow pipe,12,. Reference character 2 is the interim basin,2, with waterfall supply pipe,11 extending to the upper distribution basin,3, shown as a component supported primarily by a waterfall facing material,4, shown dotted as this is a required component of the complete waterfall system but may include several options and choices all of which are user defined. FIG. 1 and FIG. 1A show the installation of the waterfall system components,1,2,3,4 including required piping in an example structure. The interim basin,2, is shown in FIG. 1 installed in the flush with floor configurations,9, with supporting brackets,13. The interim basin, 2, may be installed as in FIG. 2 to any floor recess level from flush with floor,9, to top of floor,10, and all intervals in between. It should be noted that the remote reservoir, FIG. 1A and FIG. 2A, may be located practically any distance away laterally, longitudinally, and below the interim basin,2, as desired and is shown here in FIG. 1A and FIG. 2A simply below for graphic clarity. FIG. 1 shows an example wall support structure,8 to which the upper distribution basin,3, is installed.

Figure 3:
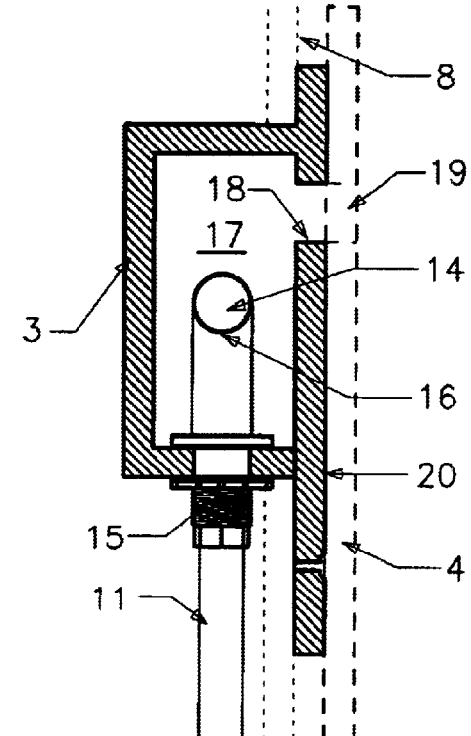
FIG. 3 is a detailed section through the upper distribution basin showing the distribution manifold below the discharge slot.

FIG. 3 shows the upper distribution basin component,3. The upper basin distribution manifold,14, regulates the surge produced by the incoming water from supply pipe,11 through the watertight bulkhead fitting,15, into the distribution manifold,14, through small orifices along the manifold lower edge,16. As water is regulated through the manifold, 14, it then collects within the upper basin discharge area,17, to arrive to a level horizontal discharge point,18, at the upper basin discharge slot,19 and onto the waterfall facing material,4. The upper distribution basin,3, and assemblies are designed to produce a smooth continuous flow of water onto the waterfall facing material,4, without surge or splash. The discharged water is directed away from the edges of the waterfall facing material,4, by means of a narrow horizontal discharge slot,19, by regulating water surge via the upper distribution basin,3, distribution manifold,14, and upper basin discharge area,17, and directing discharged water by means of the discharge slot,19 a smooth flow of water follows vertically down the vertical face of the waterfall facing material,4, without flowing to or beyond the edge of the waterfall facing material,4. Consequently, there is no need to enclose the vertical edges of the waterfall facing material,4, to contain the flow of water. The upper basin discharge slot,19, is a narrow rectangular slot aligned with the horizontal discharge point,18, of the waterfall facing material,4. The upper distribution basin,3, requires a front mounting flange,20, that is used to mount the waterfall facing material,4,. The horizontal discharge point,18, of the front mounting flange,20, determines the opening location of the discharge slot,19. The upper basin discharge area,17, is an area required to collect, regulate and distribute the incoming water prior to the water discharging onto the waterfall facing material,4. Watertight bulkhead fittings,15, are employed throughout each waterfall system component where required for watertight penetrations. It should be noted that as an individual waterfall system component, the upper distribution basin,3, is dependent upon the waterfall facing material,4, to provide continuity of the complete waterfall system. The upper distribution basin,3, is supported by the front mounting flange,20, by mechanical means onto any support wall,8, to which the waterfall system is installed. The independent nature of the upper distribution basin component,3, provides for a waterfall system of various user defined installation heights.

Figure 3A:
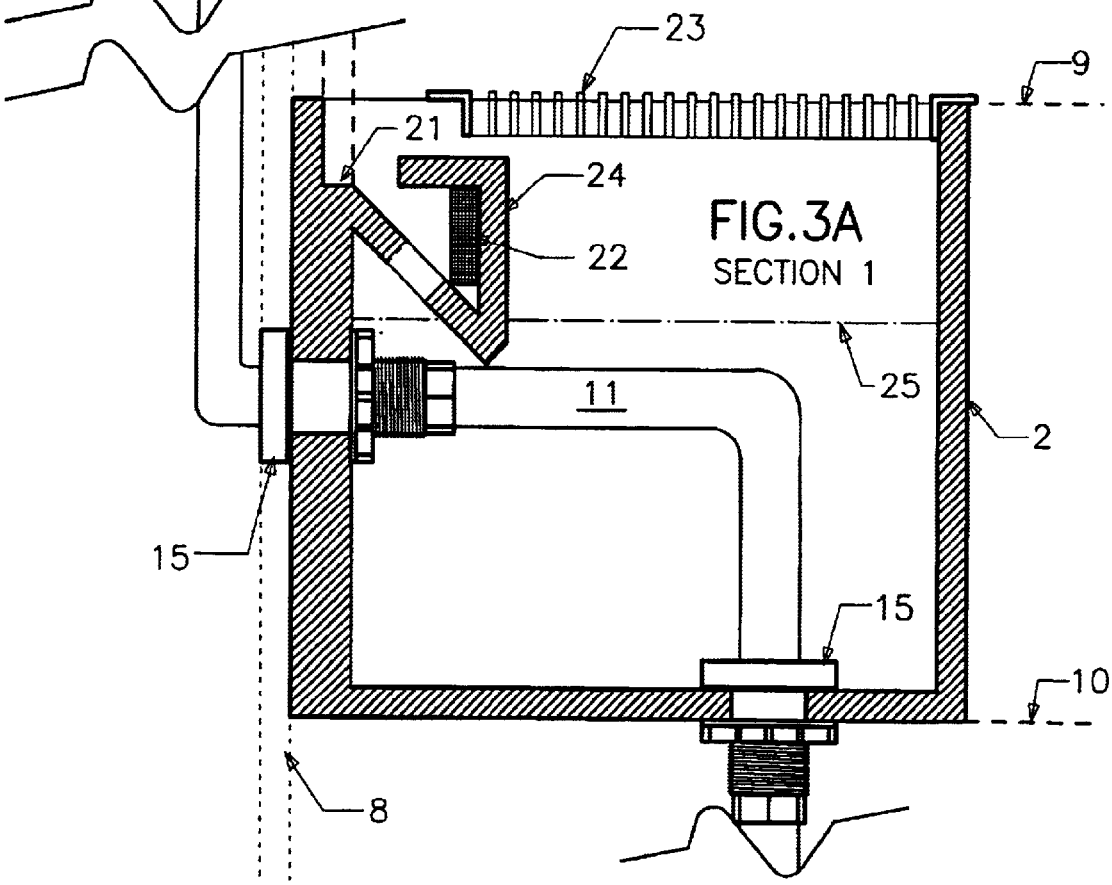
FIG. 3A is a detailed section through the interim basin showing the perforated cant strip and removable acoustical grille.

FIG. 3 and FIG. 3A show how the waterfall facing material,4, is supported by a continuous setting shelf,21, to allow individual segments of waterfall facing materials,4, to be joined together along their vertical edge by any means necessary when the weight or nature of the facing material,4, requires separate segments to be joined for practical or aesthetic purposes. Water flows down a vertical waterfall facing material,4, where it passes through a small receiving slot FIG. 3A,22, which is formed by one edge of the acoustical grille,23, a set distance from the facing material,4. The acoustical grille,23, serves three purposes: one to enhance the sound of the falling water to resonate without echo; two, to contain the splashing of the water as it contacts the perforated cant strip,24, and interim basin,2, and three, to conceal and provide access to the interior of the interim basin,2. The interim basin,2, may be installed flush with flooring,9, or surface mounted to floor,10. As water strikes the perforated cant strip,24, it is deflected into the interim basin,2, to simulate the sounds of a natural stream and to a set waterlevel,25, which is determined by the height of the return/overflow pipe, FIG. 4,12.

Figure 4:
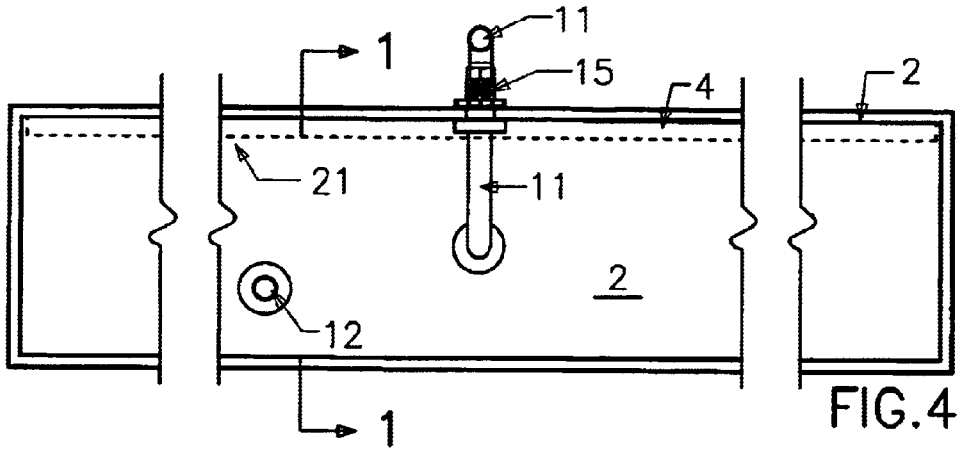
FIG. 4 is a plan view with the acoustical grille removed showing the supply pipe from the remote reservoir and return/overflow pipe of the interim basin.

FIG. 4 shows the waterfall supply pipe,11, continues through the interim basin,2, from the remote reservoir FIG. 2A,1, through a series of water tight bulkhead fittings,15, to rigid or flexible plumbing pipe,11, between components.

Figure 5:
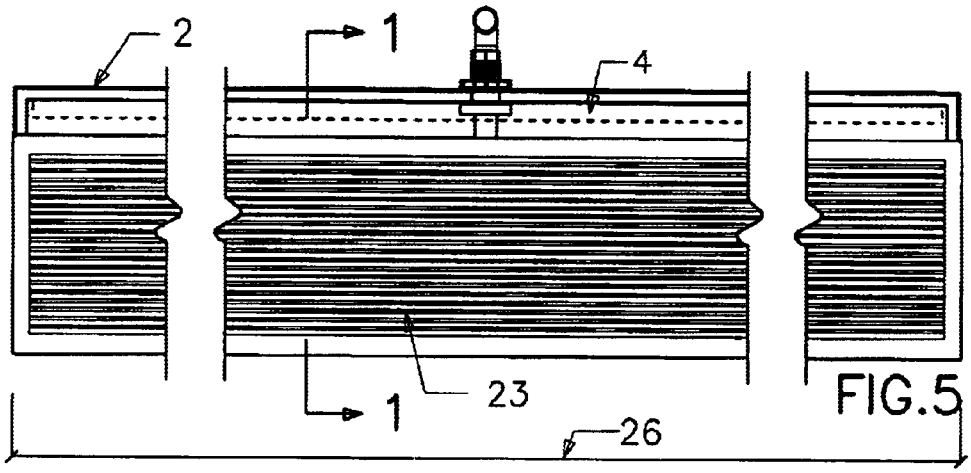
FIG. 5 is a plan of the interim basin showing the removable acoustical grille in place.

FIG. 5 shows the interim basin,2, from above with the acoustic grille,23. FIG. 5, further shows that the width,26, varies and may be manufactured to any dimension interval or a custom size.

Figure 6:
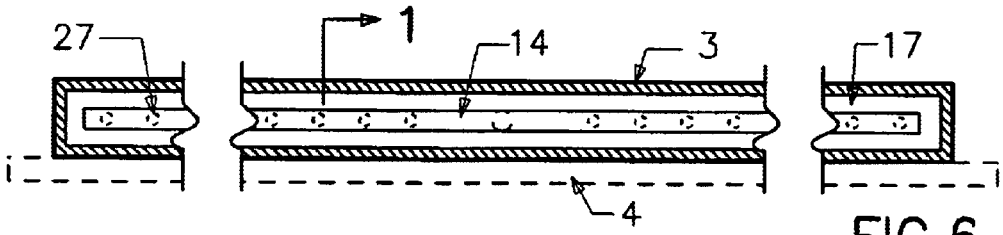
FIG. 6 is a plan/section of the upper distribution basin, showing distribution manifold and the method in which water is regulated and distributed through small orifices along the length of the distribution manifold.

FIG. 6 shows the upper distribution basin,3, manifold,14, in plan showing the arrangements of orifices within the manifold,27, to allow the incoming surge of water to distribute evenly prior to entering the upper basin discharge area,17, and discharging onto the facing material,4,.

Figure 7:
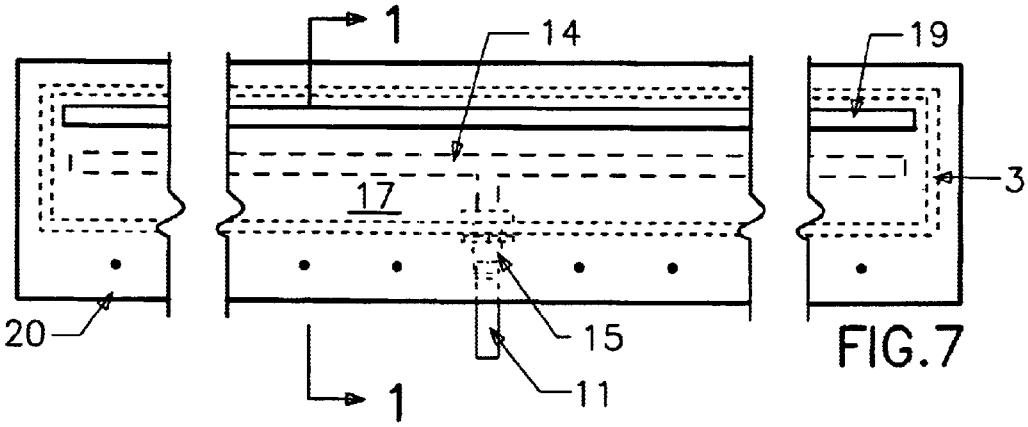
FIG. 7 is a front elevation of the upper distribution basin component showing discharge slot and water distribution manifold located within the upper distribution basin and below the opening of the discharge slot.

FIG. 7 shows the upper distribution basin,3, including the discharge area,17, manifold,14, water supply pipe,11, and front mounting flange,20.

Figure 8:
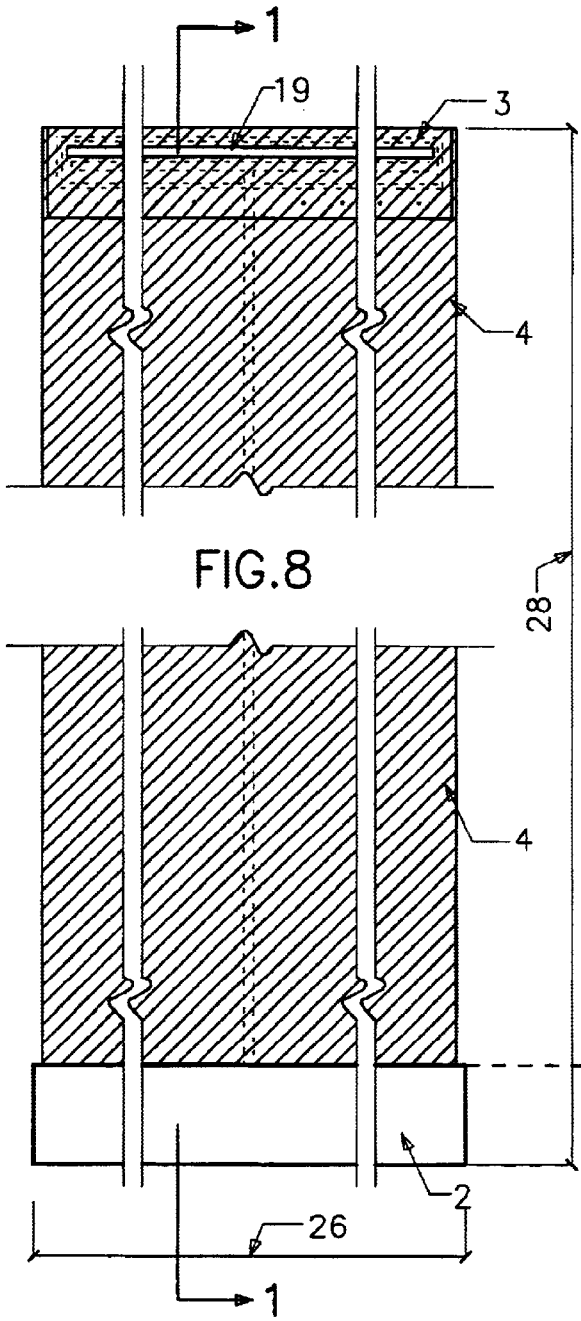
FIG. 8 is a front elevation of the waterfall system illustrating the variability of user determined sizing for height and width of the final waterfall by means of facing material size (remote reservoir not shown).

FIG. 8 shows the waterfall system's inherent variability to height,28, and width,26, options. The waterfall facing material,4, is a user defined component that determines the finished height,28, of the final assembly. The interim basin, 2, supports the facing material,4, from a continuous setting shelf, FIG. 3A,21, of the lower basin,2. FIG. 8 also shows the upper basin discharge slot,19,.

Figure 9:
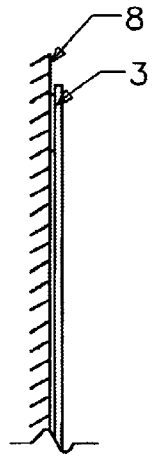
FIG. 9 is a side elevation showing the waterfall facing material vertical and parallel to installed wall plane.

FIG. 9 shows the waterfall system flush installed to the surface of a wall,8, as an example of one possible installation.

Figure 10:
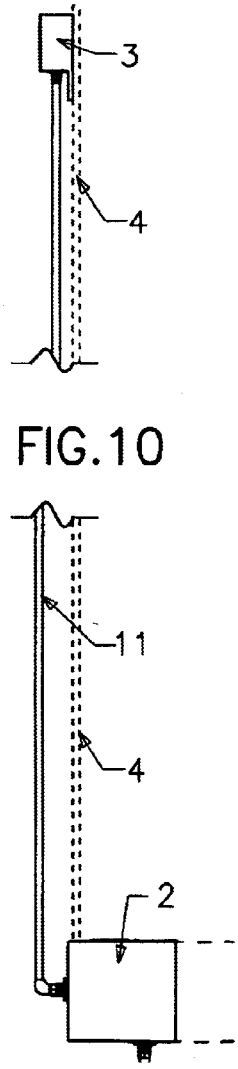
FIG. 10 is a side elevation showing the constituent parts of the waterfall system (less remote reservoir) with waterfall facing material shown dotted.

FIG. 10 shows the waterfall system and it's constituent components: upper distribution basin,3, waterfall surface material,4, and interim basin,2. The remote reservoir, FIG. 2A,1 is not shown in FIGS. 8 through 10, however is an optional component of this system. FIG. 10 further shows the component nature of the waterfall system. The waterfall supply pipe, FIG. 10,11, may by-pass the interim basin,2, and connect directly to a remote located pump.

Figure 11:
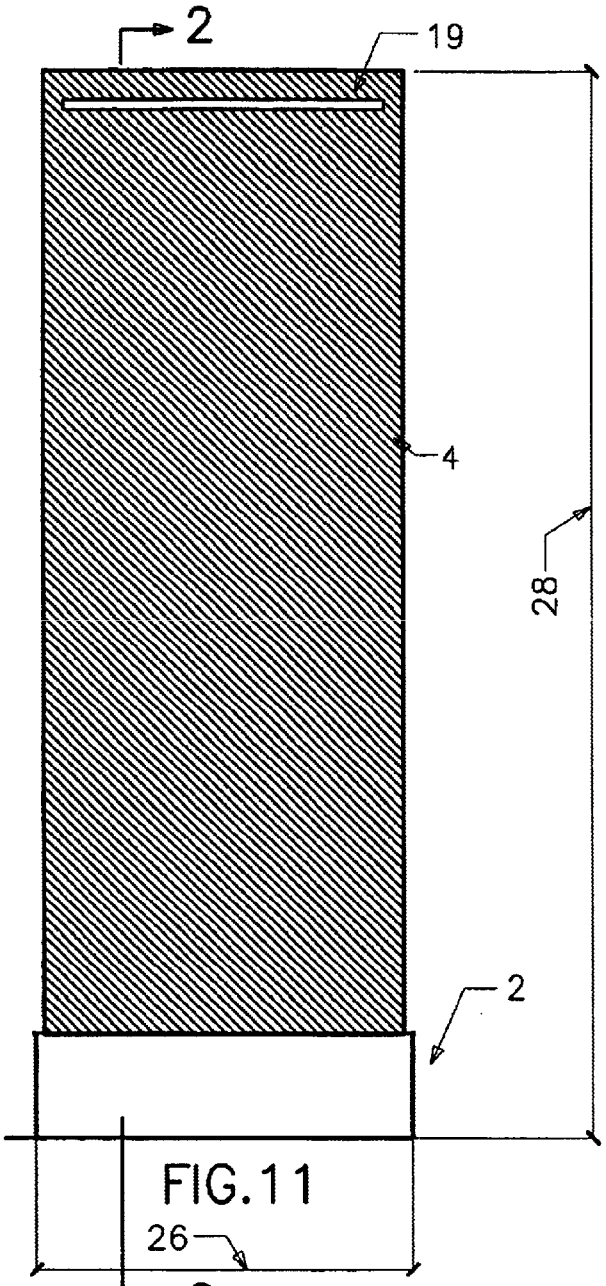
FIG. 11 is a front elevation showing the waterfall system without a remote reservoir component, wherein the interim basin serves as the lower reservoir and pump area and as a self-contained waterfall system.

FIG. 11 shows the waterfall facing material,4, interim basin,2, and upper basin discharge slot,19, assembled as the waterfall system. As is the nature of the waterfall system height,28, and width,26, are variable. It should be noted that the waterfall system may be used without the remote reservoir component, FIG. 2A,1 as shown in FIG. 12.

Figure 12:
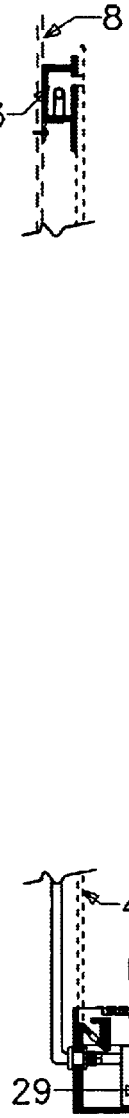
FIG. 12 is a section showing a waterfall system installation onto the surface of a supporting wall and as a self-contained waterfall system without a remote reservoir.

FIG. 12 shows the waterfall system surface mounted to the surface of a wall,8, and utilizing a pump,29, for re-circulating water from the interim basin,2.

Figure 13:
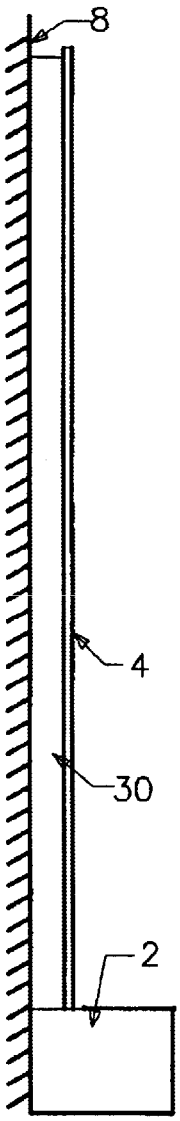
FIG. 13 is a side elevation showing a waterfall system installation onto the surface of a supporting wall with a vertical cover plate to conceal vertical water supply piping.

FIG. 13 shows the waterfall system mounted to the surface of a wall,8, and the addition of a vertical cover plate,30, to conceal plumbing and fastening components.

Figure 14:
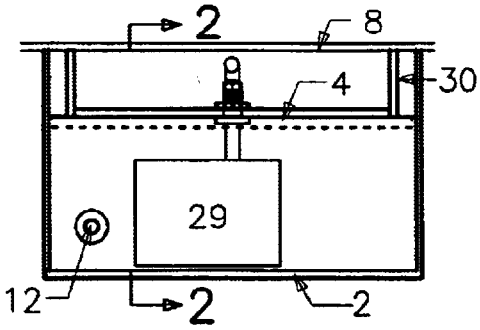
FIG. 14 is a plan of a self-contained waterfall system without a remote reservoir component.
Figure 15:
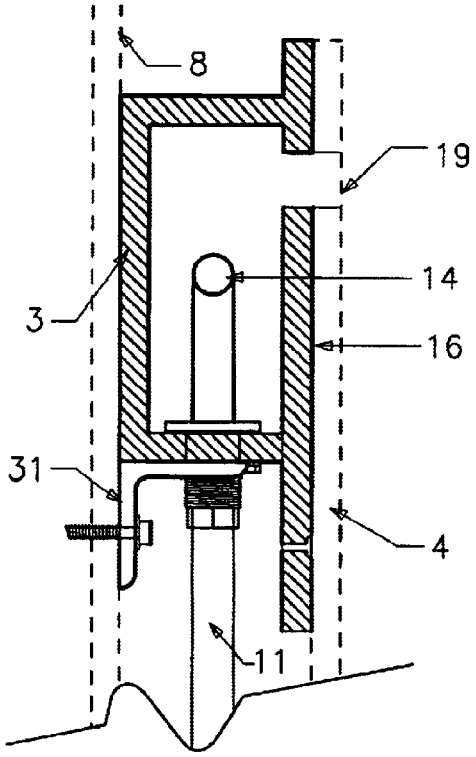
FIG. 15 is a detailed section of a waterfall system installation onto the surface of a supporting wall showing support flange for the upper distribution basin.
Figure 15A:
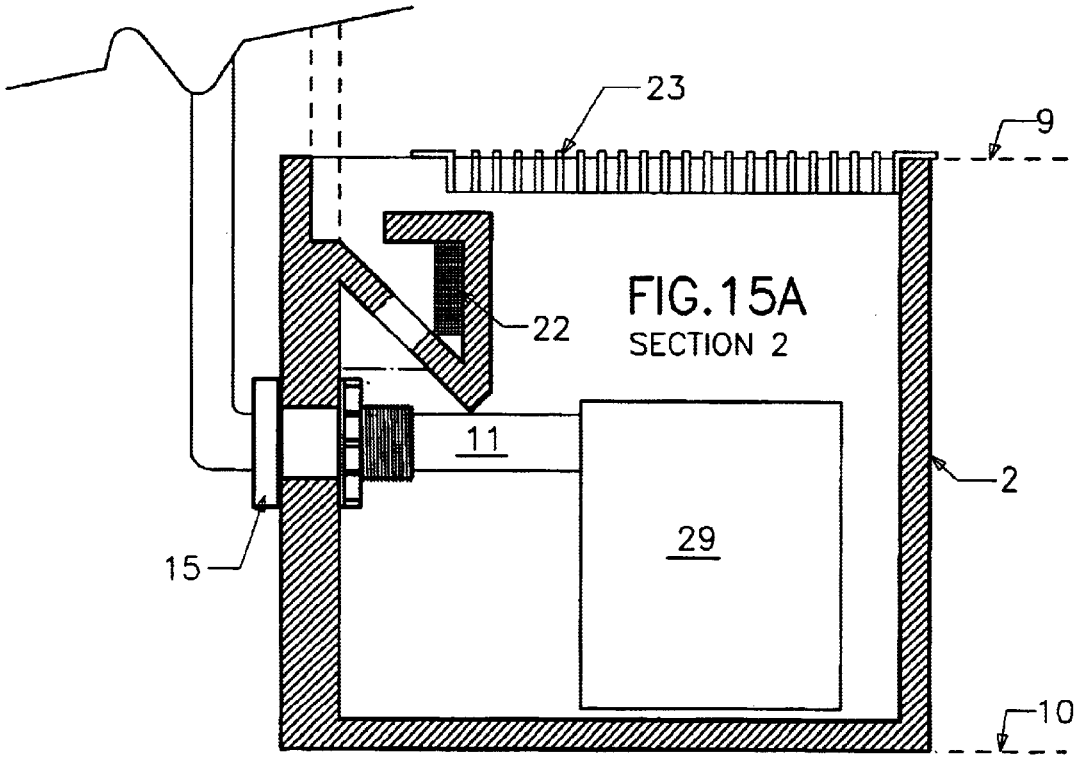
FIG. 15A is a detailed section of the interim basin showing the acoustical grille, and submersible pump as a option to a remote reservoir component, pump and reservoir.

FIG. 14 shows the lower interim basin,2, modified for use without the remote reservoir component, FIG. 2A, 1. The interim basin, FIG. 14,2, is modified for the following components: integrated pump,29, for self-contained water re-circulating, FIG. 15 and FIG. 15A show the waterfall system in detail, modified to operate without a remote reservoir component. FIG. 15 and FIG. 15A also show a wall surface,8, installation where support flange,31, is required to support the upper distribution basin,3. FIG. 15 and FIG. 15A show the conversion of the interim basin,2, to a self-contained basin, FIG. 15A,2, incorporating an integral pump,29, within the interim basin. It should be noted that the waterfall system as shown in FIG. 1 through FIG. 15A may be manufactured to a curvilinear form and that all the previously mentioned waterfall system components included in FIG. 1 through FIG. 15A may be manufactured to any radius to meet a users requirements.

FIG. 16 through FIG. 19 show the ability of the waterfall components to be formed or manufactured of a curvilinear manner to any radus,32.

Figure 16:
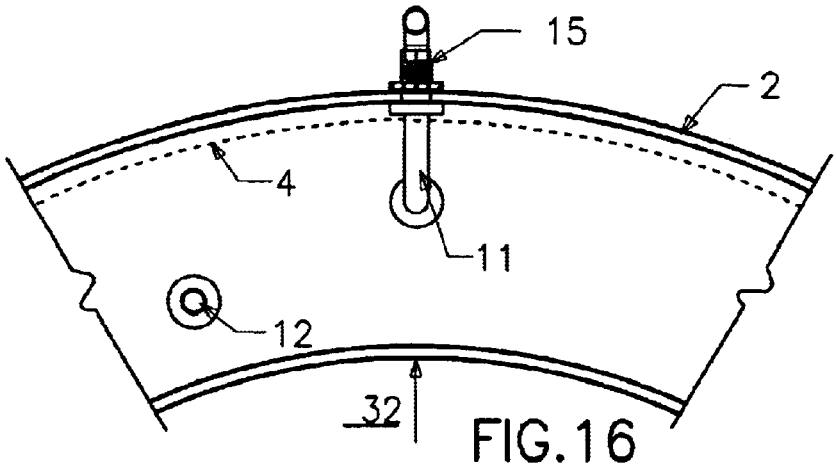
FIG. 16 is a curvilinear plan view of the interim basin with the acoustical grille removed showing the supply pipe from the remote reservoir and the return/overflow pipe of the interim basin.

FIG. 16 shows the lower interim basin,2, in a curvilinear form of any radus,32.

Figure 17:
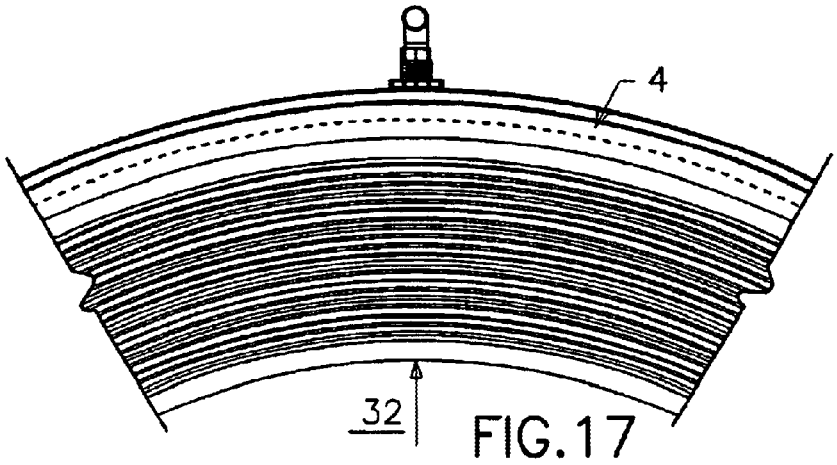
FIG. 17 is a curvilinear plan view of the interim basin showing the removable acoustical grille.

FIG. 17 shows the lower interim basin,2, in a curvilinear form of any radius showing the curvilinear grille,23.

Figure 18:
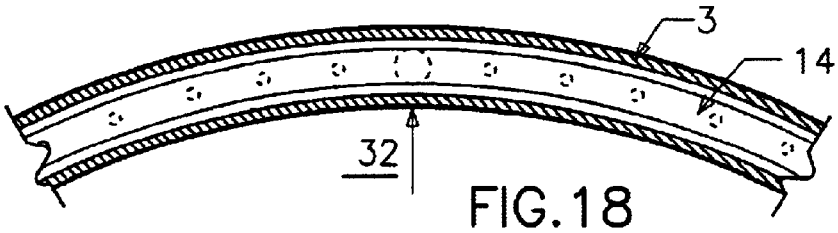
FIG. 18 is a curvilinear plan / section view of the upper distribution basin.

FIG. 18 shows the upper distribution basin,3, in a curvilinear form of any radius,32.

Figure 19:
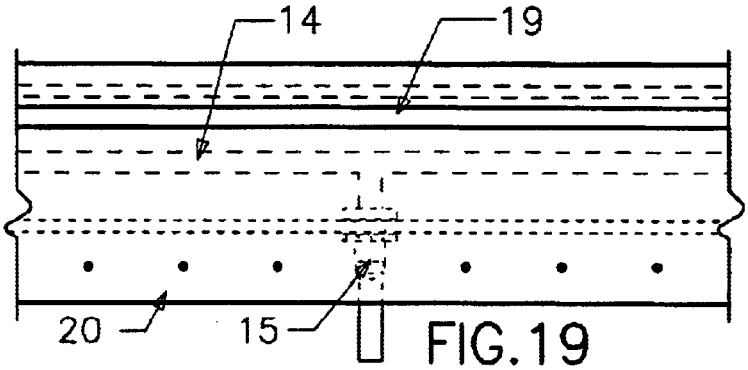
FIG. 19 is an elevation of the upper distribution basin, as it would relate to a curvilinear plan.

FIG. 19 shows the upper distribution basin,3, in a curvilinear form of any radius,32.

What I claim my invention is:

1. A system for waterfall construction comprising:

A pre-designed, engineered and manufactured system of waterfall components including:

A remote reservoir containing a pump for waterfall water circulation. A waterfall supply and return pipe, an automatic float device for automatic water replenishing and a overflow pipe;

A interim basin containing setting shelf for a waterfall facing material; a cant strip, for the simulation of natural stream sounds; an interim basin grille, to conceal components within interim basin, enhance sound and contain splash; a water supply pipe, and a water overflow/re-circulation pipe;

An upper distribution basin containing a manifold, a water distribution area, a horizontal discharge slot at the discharge area, and a front mounting flange to adhere a waterfall facing material to;

A waterfall facing material that may include stone, glass, metal, acrylic or any other suitable material, all of which may be incorporated into the waterfall system as a user furnished component.

2. A system of components for waterfall construction and assembly according to claim 1 designed for and intended for use by a user wherein:

Each constituent waterfall system component and related parts when assembled by a user constitute a complete waterfall assembly;

A user installs and determines final height, width, configuration, installation preferences, and waterfall facing material.

3. A waterfall system according to claim 1 that may be modified for use without a remote reservoir component and pump.

4. A waterfall system according to claim 1 that produces a waterfall without continuous vertical side panels or walls to channel water flow. The water flow is determined and controlled from within the upper distribution basin and horizontal discharge slot. The waterfall facing material is chosen by a user and does not require side panels to contain water flow.

* * * * *